US006082577A

United States Patent [19]

Coates et al.

[11] Patent Number: 6,082,577

[45] Date of Patent: Jul. 4, 2000

[54] CABLE TIE DISPENSING APPARATUS

[75] Inventors: Timothy K. Coates, Germantown; Preston M. Eason, Bartlett; Paul J. Bartholomew, Memphis; Julio F. Rodrigues, Collierville, all of Tenn.; John J. Students, Brick, N.J.

[73] Assignee: Thomas & Betts International Inc., Sparks, Nev.

[21] Appl. No.: 09/377,650

[22] Filed: Aug. 19, 1999

Related U.S. Application Data

[63] Continuation of application No. 09/124,499, Jul. 29, 1998

[60] Provisional application No. 60/054,162, Jul. 29, 1997, provisional application No. 60/062,685, Oct. 22, 1997, provisional application No. 60/077,487, Mar. 11, 1998, and provisional application No. 60/082,499, Apr. 21, 1998.

[51] Int. Cl.[7] ..... G07F 11/00; B65G 59/00; B65H 3/08

[52] U.S. Cl. ..... 221/80; 221/278; 83/647; 227/66

[58] Field of Search ..... 221/80, 10, 13, 221/198, 278; 140/93.2; 227/66–68; 83/32, 100, 647

[56] References Cited

U.S. PATENT DOCUMENTS

| | | |
|---|---|---|
| 3,976,108 | 8/1976 | Caveney et al. . |
| 4,371,011 | 2/1983 | Hidassy . |
| 4,790,225 | 12/1988 | Moody et al. . |
| 5,018,535 | 5/1991 | Da Silva et al. . |
| 5,140,880 | 8/1992 | Littleton . |
| 5,144,989 | 9/1992 | Mika et al. . |
| 5,722,466 | 3/1998 | Levin et al. . |

*Primary Examiner*—Christopher P. Ellis
*Assistant Examiner*—Gene O. Crawford
*Attorney, Agent, or Firm*—Hoffmann & Baron, LLP

[57] ABSTRACT

An improved cable tie dispensing apparatus includes a cutting and feeding apparatus which advances and severs a cable tie from an elongate strip of cables ties for delivery to an automatic cable tie installation tool. The cutting and feeding apparatus provides an elongate platform for supporting a cable tie strip therealong and a severing location adjacent one end of the platform which is defined to support one cable tie. An alignment pilot is supported adjacent the severing location and is movable towards the severing location so as to separate the supported cable tie from the strip to which it is connected. The alignment pilot includes a punch for severing the web between adjacent cable ties upon movement of the pilot toward the severing location. A firing chamber is included which has an open face for insertion of a single cable tie therein. The open face is sealably closed by movement of the pilot toward the severing location. In this manner, a single cable tie is separated from the web and almost instantaneously positioned for delivery to an installation tool.

29 Claims, 8 Drawing Sheets

CABLE TIE DISPENSING APPARATUS

This application is a continuation of U.S. patent application 09/124,499, filed Jul. 29, 1998, and entitled "IMPROVED CABLE TIE DISPENSING APPARATUS" which claims the benefit of the filing date of U.S. Provisional Application No. 60/054,162, filed Jul. 29, 1997, and entitled "IMPROVEMENTS IN CABLE TIE DISPENSERS", U.S. Provisional Application No. 60/062,685, filed Oct. 22, 1997 and entitled "AUTOMATIC CABLE TIE DISPENSER", U.S. Provisional Application No. 60/077,487, filed Mar. 11, 1998 and entitled "AUTOMATIC CABLE TIE DISPENSERS INCLUDING IMPROVED PUNCH PILOT", and U.S. Provisional Application No. 60/082,499, filed Apr. 21, 1998 and entitled "ADDITIONAL IMPROVEMENTS IN DISPENSER FOR CABLE TIE TOOL".

FIELD OF THE INVENTION

The present invention relates generally to dispensers for dispensing cable ties. More particularly, the present invention relates to an improved automatic dispenser for successively feeding cable ties from a cable tie strip to an automatic cable tie installation tool which applies such cable ties about a bundle of articles.

BACKGROUND OF THE INVENTION

Tools for applying cable ties about a bundle of wires or similar articles are well known. These tools may be manual, semi-automatic, or automatic. With respect to automatic cable tie installation tools, cable ties are typically fed to the tool from a continuous strip or reel of ties. The reel of ties may be contained in a cartridge that is mounted directly on the tool or supported in a remote dispenser which is interconnected to the tool by a hose. Typical examples of such cable tie installation tools and cartridges and dispensers therefor are described in U.S. Pat. Nos. 4,790,225, 4,371,011 and 3,976,108.

In many of the tools of the prior art, individual cable ties are cut from a continuous strip of such cable ties and then an individual cable tie is fed to the installation tool where the tool applies the cable tie around a bundle of wires or other objects. These cable tie dispensing and installation tools of the prior art are not without problems. Quite often, complicated mechanisms must be employed to accommodate a continuous strip of cable ties, individually cut the cable ties from the strip and feed the individual cable tie to the installation tool. This procedure is further complicated where the installation tool is located distally from the dispenser. Such remote location of the tool with respect to the dispenser results in various problems such as jamming of the ties and inaccurate dispensing or positioning of the tie. This results in misalignment of the tie within the tool and subsequent retention problems after tying is complete.

In certain designs, a rotating drum supports a continuous strip of cable ties. Rotation of the drum moves each tie to a firing chamber where the tie is cut and fired to the tool. However, such drums are bulky and contribute significantly to the size and weight of the unit.

In feeding cable ties individually from a bundle of ties to the installation tool, the individual cable ties must be cut from a continuous strip. Many of the cable tie dispensers include mechanisms for effecting cut-off of the cable tie from the strip. In the efficient operation of the cable tie installation tool in a continuous, repetitive installation process, it is important to ensure that the individual cable tie is cut from the reel in a clean fashion, i.e., the cable tie should be cut from the reel without significant residual burrs or distortion so that the cable tie may traverse through the dispensing system and to the installation tool and may be applied around a bundle of wires or cables without interruption. In order to assure that the cable ties are cut cleanly from the strip, the strip of cable ties must be delivered to the cutting mechanism in an aligned fashion.

It is, therefore, desirable to provide a simpler and more reliable system for delivering cable ties to a dispenser and accurately severing an individual cable tie from the strip so as to accurately deliver the individual cable tie to a cable tie installation tool.

SUMMARY OF THE INVENTION

It is an object of the present invention to provide an improved cable tie dispensing apparatus.

It is another object of the present invention to provide a cable tie dispenser which successively and accurately delivers cable ties from an automatic dispenser to a cable tie installation tool.

It is yet another object of the present invention to provide a cable tie dispensing apparatus which controls the functions of both the automatic dispenser and the installation tool.

It is a further object of the invention to deliver successive ties to a location remote from a cable tie dispensing apparatus.

It is still a further object of the invention to integrate storage, dispensing and delivery of cable ties in a single apparatus.

In the efficient attainment of these and other objects, the present invention provides a dispensing apparatus for advancing and severing a cable tie from an elongate strip of cable ties which are interconnected by a single web. The dispenser automatically delivers the cable ties in succession to a cable tie installation tool affixed thereto. The dispensing apparatus includes an elongate platform for supporting a cable tie strip and an advancement mechanism for advancing the cable tie strip along the platform to a firing chamber having an entrance for advancement of a leading cable tie therein. A movable door selectively seals the leading cable tie within the chamber and a cutter defined thereon severs the leading cable tie from the strip after advancement of the tie into the firing chamber. The advancement mechanism continues to feed cable ties into the firing chamber for subsequent separation from the strip and eventual transfer to the installation tool.

In a preferred embodiment, an alignment pilot is supported adjacent the firing chamber which is movable for insertion between adjacent cable ties so as to separate one cable tie from another. The alignment pilot includes a punch for severing the web which interconnects adjacent cable ties upon movement of the pilot toward the ties. In this manner, the alignment pilot separates one cable tie from the web and simultaneously positions a separated cable tie for delivery to a cable tie installation tool. The pilot is generally an elongate member having a pair of opposed walls. The walls are progressively engageable with adjacent cable ties so that movement of the pilot effects separation of a cable tie from a cable tie strip.

A method for advancing and severing a cable tie for a strip of consecutively attached cable ties is also provided which includes positioning a cable tie within a firing chamber while it is still affixed to a cable tie strip. The firing chamber has an open face for permitting insertion of a cable tie therein that is sealably closed by movement of the pilot toward the severing location. In operation, the firing chamber separates the cable tie housed therein by severing the web between adjacent cable ties in a cable tie strip. The severed cable tie is enclosed in the firing chamber and then delivered to the installation tool.

DETAILED DESCRIPTION OF THE PREFERRED EMBODIMENT

Figure 1:
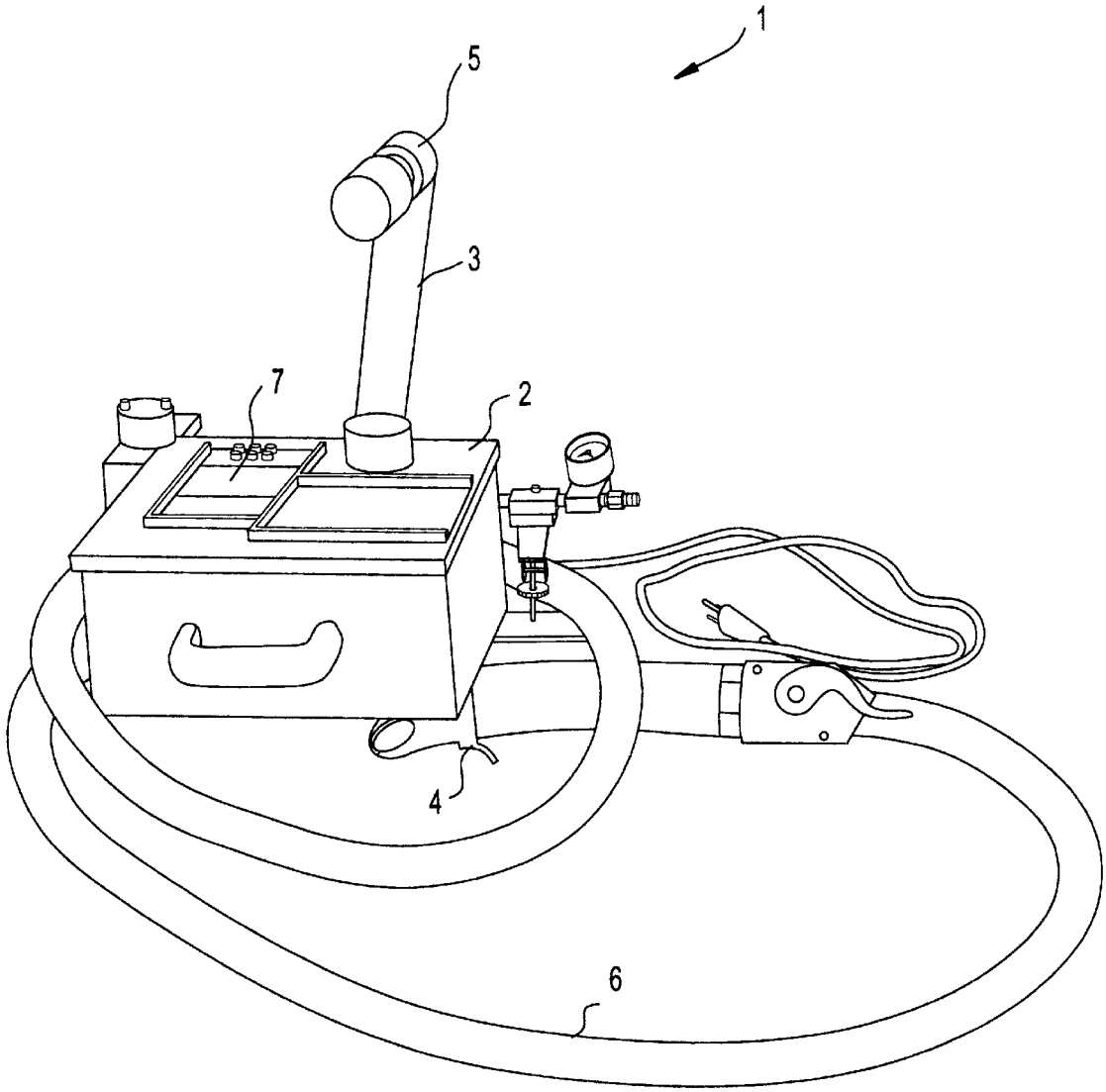
FIG. 1 shows an automatic cable tie application assembly including a cable tie dispensing apparatus of the present invention.

Referring to the drawings, in which like elements are identically numbered, FIG. 1 shows a cable tie dispensing apparatus 1 of the present invention which includes a dispenser housing 2, an installation tool 4 and a flexible feed tube 6 therebetween. The dispenser unwinds a reel of cable ties (not shown) which are affixed to one another in a continuous strip, referred to as a bandolier, precisely feeds a leading tie of the bandolier into position, separates and severs the leading tie from the remainder of the bandolier and transports the severed tie through a flexible tube 6 to an installation tool 4 that is remotely located from the dispenser housing 2. As will be described in further detail hereinbelow, each cable tie is advanced into a firing chamber by a spring-loaded finger for subsequent separation from the cable tie bandolier. The firing chamber has an open face which is sealed by an actuating pilot, whereby the pilot moves in a reciprocating manner to isolate the cable tie and sever it from the cable tie strip. Upon separation of the cable tie, the firing chamber can isolate the tie and align it with a tube which will transport the tie to an installation tool for use in securing bundled items.

Now referring to FIGS. 2 to 8, the components of the present cable tie dispensing system may be described.

Figure 2:
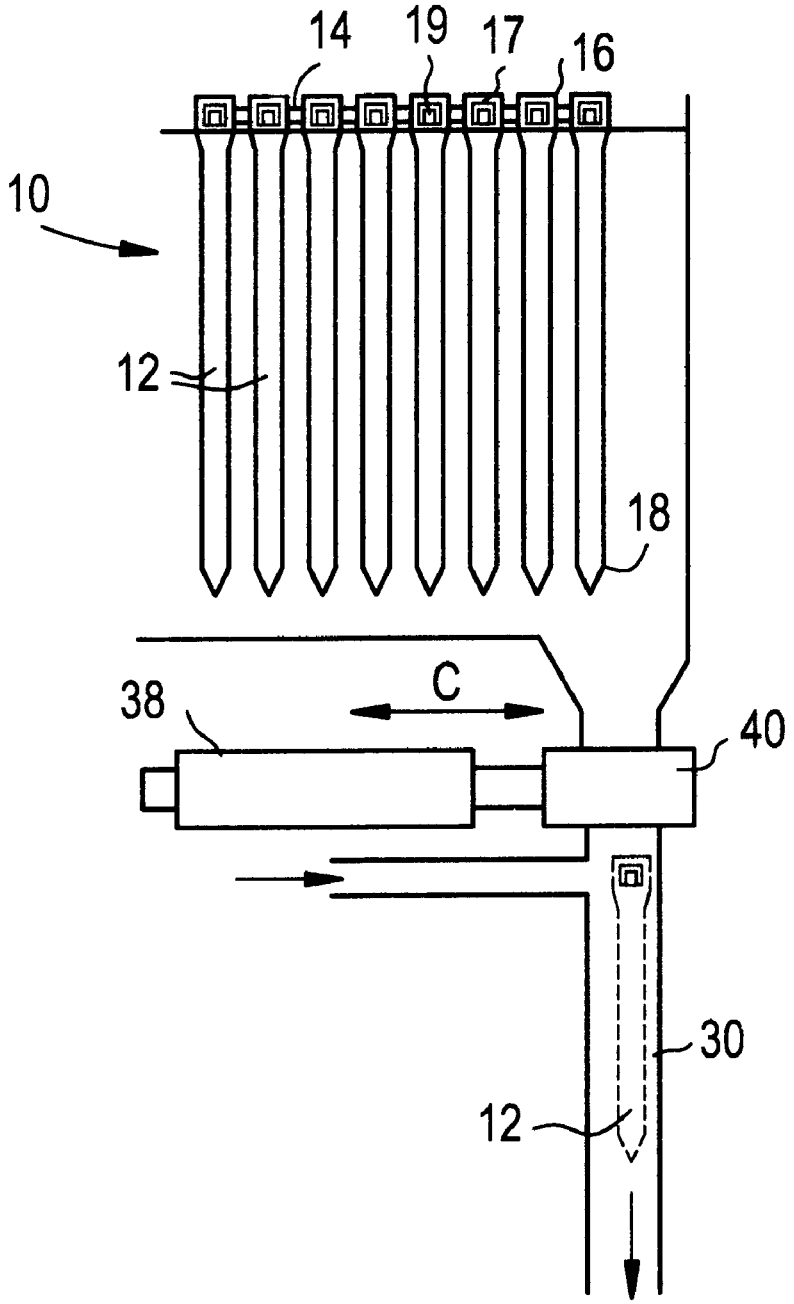
FIG. 2 is a schematic representation of selective operation of a feeding and cutting apparatus of the cable tie dispensing apparatus of FIG. 1.

Referring now to FIG. 2, a schematic representation of a feeding and cutting apparatus of a dispenser for dispensing individual cable ties to an installation tool is shown. A bandolier includes individual cable ties 12 interconnected by a web 14. The web 14 interconnecting the cable ties in the particular example shown herein is a single web located approximately between the centers of the cable tie along tie head 16.

Figure 3:
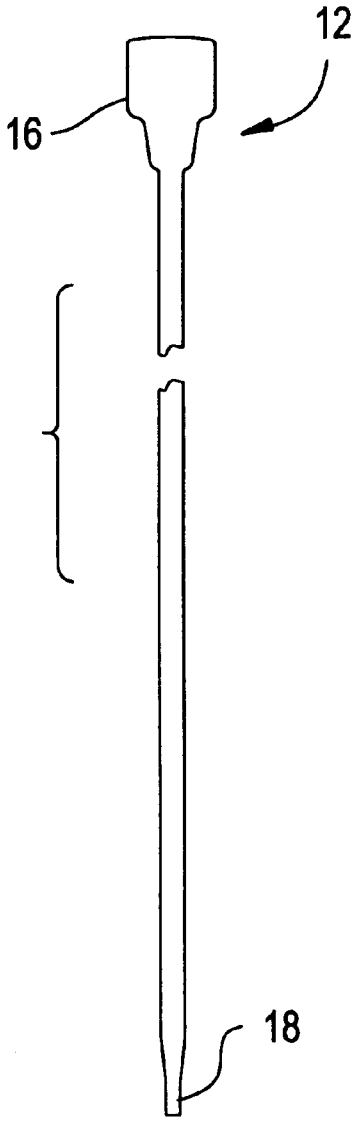
FIGS. 3 and 3A are side and front views, respectively, of a cable tie embodiment used with the present invention.
Figure 3A:
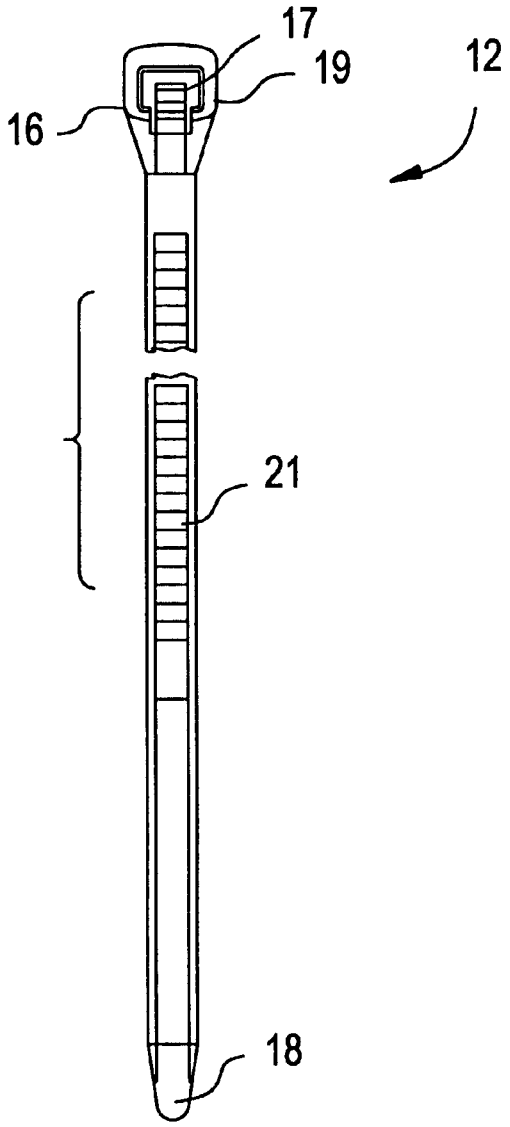

The cable tie 12 may be of the type shown and described in commonly assigned U.S. Provisional Patent Application Serial No. 60/066,128, filed Nov. 21, 1997. As best shown in FIGS. 3 and 3A, each cable tie has a head 16 including an aperture 17 therethrough. The tie includes a tail 18 at an opposed end with a stop body therebelow. The tail 18 may be inserted through aperture 17. A locking mechanism 19 is supported in the head. The locking mechanism is operable to lock the stop body in the head once the cable tie is wrapped around a bundle of articles. The particular cable tie shown herein is a "hammerhead" cable tie capable of receiving the inserted tail in the head aperture in either direction. Furthermore, the locking mechanism is an integrally formed pawl for locking engagement with teeth 21 on the strap body. While an integral hammerhead cable tie is shown, it is contemplated that more conventional cable ties, including cable ties having metallic locking barbs, may also be employed with the present invention.

Figure 4:
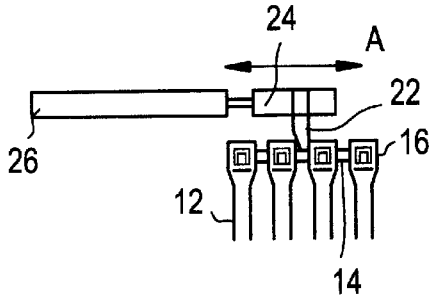
FIG. 4 is a schematic representation of a conveying system for advancement of individual cable ties of the feeding and cutting apparatus of FIG. 2.

Referring specifically to FIG. 4, the advancement of a cable tie bandolier is shown. The bandolier 10 accommodates a plurality of cable ties 12 which are generally interconnected by a web 14 between adjacent cable tie heads 16. The bandolier 10 of cable ties 12 wound on a reel (not shown) is linearly advanced by a conveying system shown. The individual cable ties may be advanced by a spring-loaded finger 22 attached to a piston 24 driven by an air cylinder 26. This piston reciprocates in the direction of arrow A. The movement of finger 22 simultaneously advances the tie strip 10 and prevents the tie strip from moving backwards. In this manner, the finger engages the head of the cable tie above the web so as to advance an individual cable tie to a location just over a feed tube 30 (shown in FIG. 2). Once one individual cable tie of the strip is located over the feed tube 30, the cable tie may be severed from the reel for delivery to an installation tool.

As shown in FIG. 4, finger 22 is biased to a position perpendicular to piston 24. Finger 22 is pivotably mounted on piston 24 and is capable of counterclockwise rotation (as viewed in FIG. 4). Upon retraction of piston 24 into air cylinder 26, finger 22 is moved away from feed tube 30. As finger 22 is moved away from feed tube 30, it rotates counterclockwise upon contacting the heads of the cable ties 12 of bandolier 10. IN this position, finger 22 is locked against any clockwise rotation. Accordingly, as the finger is moved away from the feed tube, it "snaps" into the open region between adjacent cable tie heads due to the biasing spring, which applies a clockwise biasing force.

Figure 5:
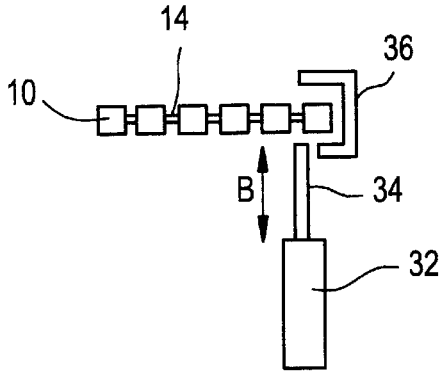
FIG. 5 is a schematic representation of a severing device for separation of cables from a cable tie strip of the feeding and cutting apparatus of FIG. 2.

As shown in FIG. 5, a second air cylinder 32 operates a cutting punch 34 which is moveable in the direction of arrow B. The punch is sized to fit between the heads of the adjacent cable ties to sever the web from between the cable tie heads. Once severed from the strip, the cable tie is positioned above the feed tube 30 in an area defined as firing chamber 36. The cable tie drops by gravity into the feed tube. Feed tube 30 includes an additional air cylinder 38 which operates a seal mechanism 40 below the firing chamber. The seal mechanism is movable with respect to the feed tube to allow passage of the cable tie therethrough. Once the cable tie passes below the air cylinder and seal mechanism as shown in dotted lines in FIG. 2, the air cylinder propels the seal mechanism into sealing engagement with the feed tube. A blast of air is then fed into the feed tube above the head of the severed cable tie to propel the cable tie under pneumatic force through the feed tube to the installation tool.

Feed tube 30 is typically a flexible tube which extends a predetermined length from the dispenser to the installation tool (not shown), which may be located distally of the dispenser. Under the force of gravity, the severed cable may drop to any location below the seal mechanism. Such location is dictated by the shape and bending of the feed tube. The air cylinders actuating the seal mechanism, the cutting punch, as well as the feeder mechanism, all may be numerically controlled by a computer. Similarly, the blast of air which propels the cable tie through the tube may also be sequentially operated.

In a preferred embodiment, the feed tube has a rectangular cross section, which accommodates the rectangular cross-sectional shape of the cable tie head. Thus, once the tie is positioned within the feed tube, the positional orientation of the cable tie is fixed. This assures that the cable tie is delivered to the installation tool in an oriented fashion so as to ensure proper cable tie installation. However, it is contemplated that the present invention may also be employed with a feed tube of circular cross-sectional shape where other means of cable tie orientation are employed.

Figure 6:
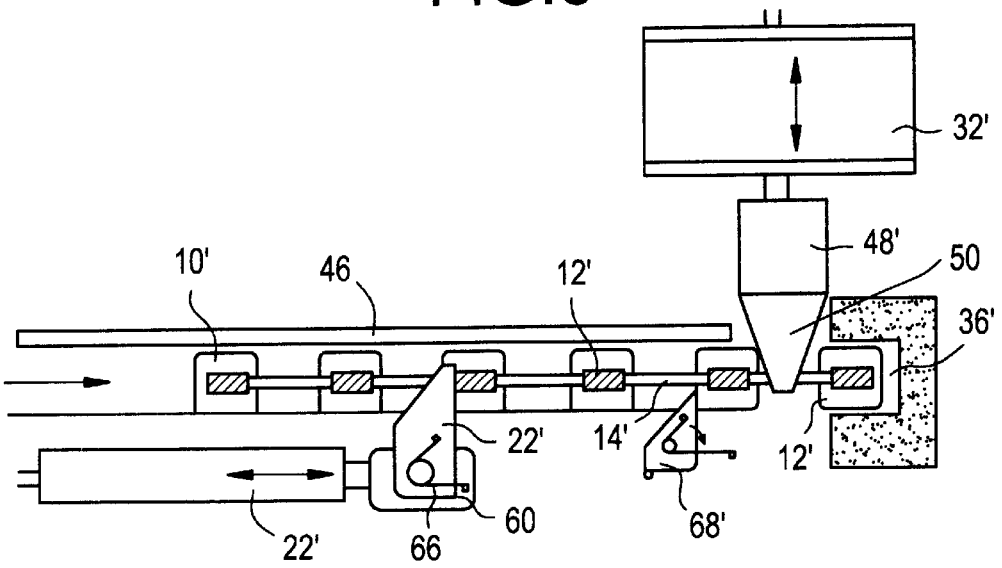
FIG. 6 is a schematic representation of the operation of a preferred embodiment of the feeding and cutting apparatus of the present invention.

Now referring to FIG. 6, a more detailed representation of a preferred embodiment of the feed and cutting apparatus of the dispenser is shown.

Figure 6A:
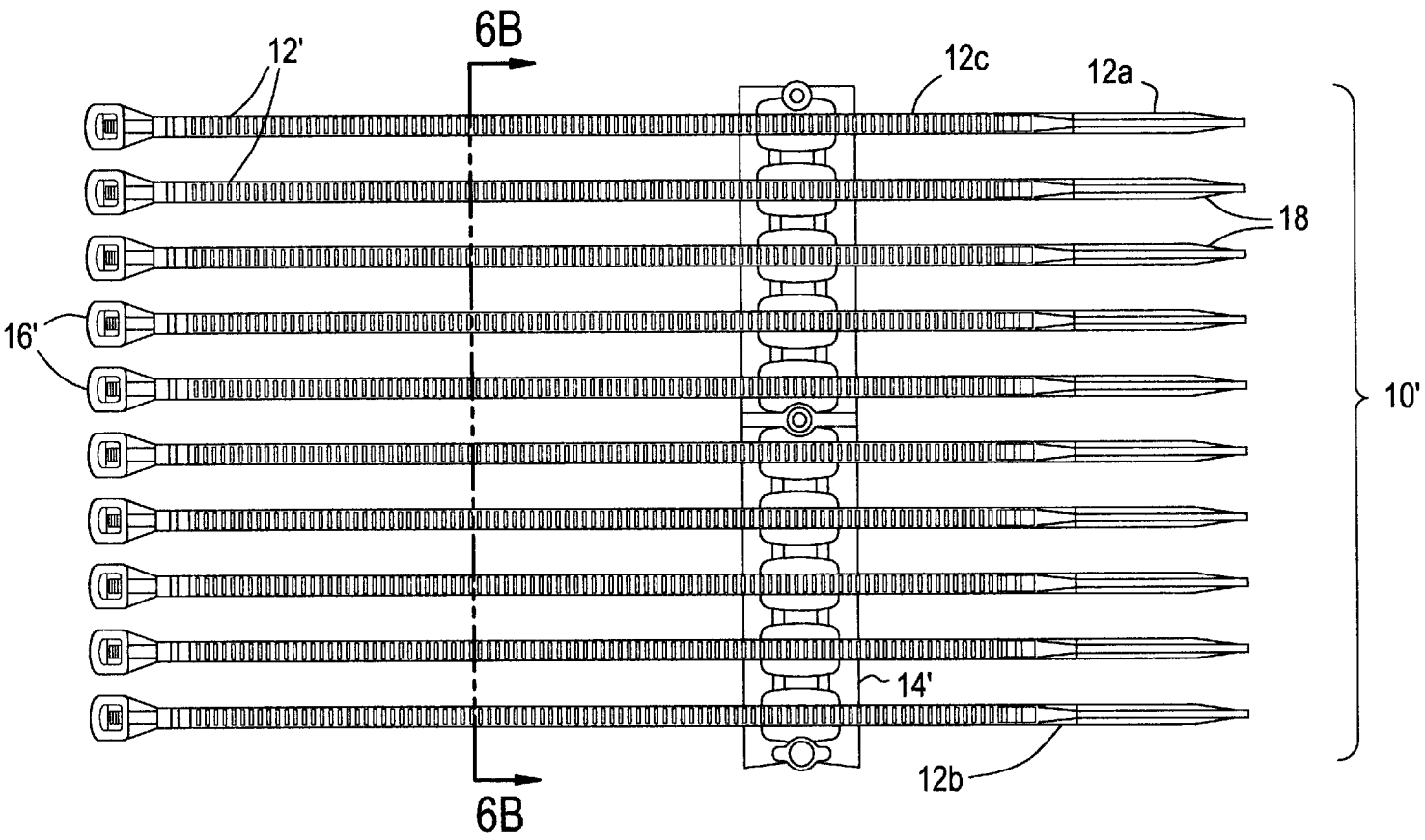
FIGS. 6A and 6B are a top view and a cross-section, respectively, of a bandolier of interconnected cable ties.
Figure 6B:
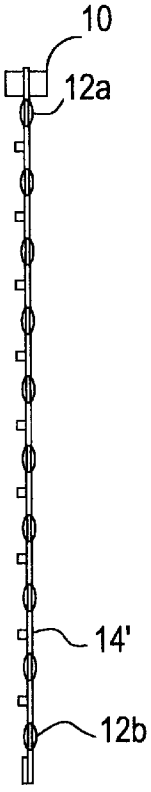

The preferred embodiment of the present invention is designed to accommodate a strip or bandolier 10' as shown in FIGS. 6A and 6B. The cable tie strip shown in FIG. 6A is substantially similar to strip 10 of FIG. 4. However, the individual cable ties are shown interconnected by a web 14 between adjacent bodies rather than between adjacent heads. A plurality of cable ties 12' may be interconnected in a strip-like fashion and wound in a reel. The bandolier 10' has a plurality of cable ties aligned in a side-by-side fashion with adjacent cable ties interconnected by a web 14' generally centrally located along a tie body 12*c*. The cable tie strip or bandolier is more fully described and shown in commonly assigned U.S. patent application Ser. No. 08/955,938, filed Oct. 22, 1997, which is incorporated by reference herein.

The molded bandolier 10' of a plurality of cable ties 12' is advanced so that each tie 12', starting with leading tie 12*a*, is sequentially fed into an elongated firing chamber 36'. This locates the bandolier in the approximate position for cutting the web. A cover plate 46 supports and encloses the bandolier until trailing tie 12*b* reaches the firing chamber.

A piston 60 is actuated by an air cylinder 26' to advance the cable tie. The piston includes a spring-loaded finger 22' which is pivotally mounted under the base of spring 66. The movement of the piston 60 advances the bandolier 10'. The spring-loaded finger 22' also prevents the bandolier 10' from moving backwards during a severing operation. An alignment pilot 48' is positioned so as to be movable under the actuation of an air cylinder 32'. The bandolier 12' is precisely aligned with the alignment pilot 48', which then cuts off the web 14'. This web 14' is ejected into a scrap chamber (not shown) for disposal.

Figure 7:
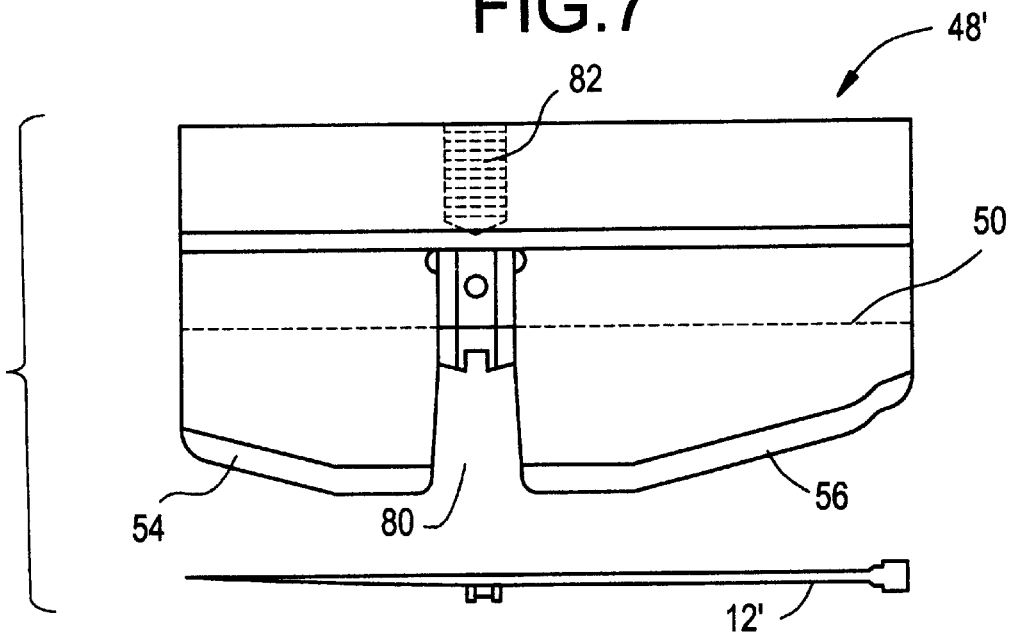
FIG. 7 and 7A are bottom and side views, respectively, of an improved punch used in a cable tie dispensing apparatus of the present invention.
Figure 7A:
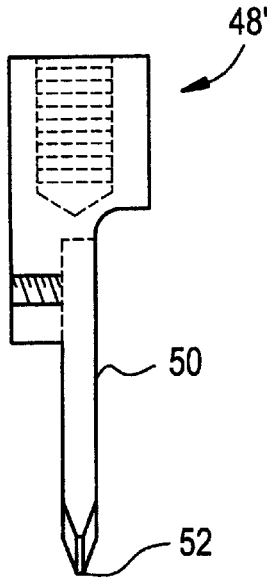

The alignment pilot 48' of the present invention may be of the construction shown in FIGS. 7 and 7A. Alignment pilot 48' is an elongate member attached to air cylinder 32' (shown in FIG. 6). The alignment pilot includes a central rectangular recess 80 which supports therein a severing blade 82. Alignment pilot 48' includes a pilot guide 50 which is an elongate depending member having a tip 52 which is tapered in cross-section. The tapered tip 52 helps facilitate the positioning of the pilot guide 50 between adjacent cable ties, thereby positioning the cable ties for accurate severing.

In order to further align the cable ties prior to severing, the improved pilot guide so shown in FIG. 7 includes beveled ends 54 and 56. The beveled ends help progressively engage both the cable tie heads and tails as the pilot guide 50 is lowered onto the bandolier 10' of cable ties 12'. Thus, if bandolier 10' is fed to the firing chamber with heads and or tails misaligned, the particular shape of the pilot guide 50 helps separate the cable ties gradually as the pilot guide is brought down onto the cable ties. This accurately aligns the cable ties to permit a clean cut-off of the web therebetween. The pilot guide, being tapered in cross-section as well as being beveled at ends 54 and 56, helps to gradually spread the cable ties if they are misaligned and simultaneously align the cable ties in proper position for severing.

Pilot guide 50 provides precise alignment between two adjacent cable ties so that the web 14' therebetween may be accurately and completely cut-off, eliminating any burrs which could adversely effect the operation of the dispenser and tool. Once the web is cut from the strip, the web 14' is ejected into a chamber for disposal.

As shown in FIG. 6, the alignment pilot 48', once lowered, closes the open side of firing chamber 36'. Since the tie head is wider than the tie body, the tie head is pushed into the chamber during this operation. Thus, the cable tie 12' is retained in the firing chamber. The size and shape of the firing chamber is selected so that the cable tie head substantially fills the firing chamber, enabling the cable tie to be advanced by a pneumatic operation to the cable tie installation tool shown in FIG. 9.

The present invention further includes an additional finger set 68 which is actuated to hold and position the cable tie 12' adjacent alignment pilot 48' to precisely and accurately maintain position during the cutting operation. Finger set 68 is also retractable to permit continued advancement of bandolier 10'.

Having schematically described the components of the feeding and cutting apparatus 7, of the present invention, the details of the preferred embodiment of the feeding and cutting apparatus 7, as well as its operation may be described with respect to FIGS. 1 and 6–8.

The feeding and cutting apparatus 7 comprises a dispenser housing or box 2 on or in which all other components are supported. A folding arm 3, mandrel 5 and corresponding nut assembly are attached to the top of the housing to hold the strip of ties wound in a reel and held on a spool (not shown). The feeding and cutting apparatus 7 is supported on the top of the housing and projects through the top into the inside of the box. A flexible feed tube connector assembly is attached inside the housing and projects through both the side and top of the housing. The flexible feed tube assembly, which is detachable, connects to a flexible feed tube connector and transmits ties to an attached installation tool, such as the tie gun 4 shown in FIGS. 1 and 9 via a flexible feed tube 6 (as shown in FIG. 1).

The spool of ties is supported by the mandrel 5 which passes through the center of the spool creating an axle about which the spool can revolve. The mandrel is attached to the arm 3, which is connected to a pivot bracket that is mounted to the top of the housing. The pivot bracket has an off center, retractable, locking pin that engages one of two detent positions in the arm, allowing the arm to rotate and lock in either a position to support the spool of ties above box and feeder (the operating position) or with the spool removed, rotated and locked in a position with the arm parallel to the top of the box (the storage and transporting position). The spool is retained on the mandrel by a quick release nut that slips over the mandrel and a spring loaded catch, located in the nut, applies pressure against the mandrel, creating sufficient friction to hold the nut and spool in position. A lever projecting from the spring loaded catch, beyond the outer surface of the nut, when depressed, will release the nut.

Figure 8:
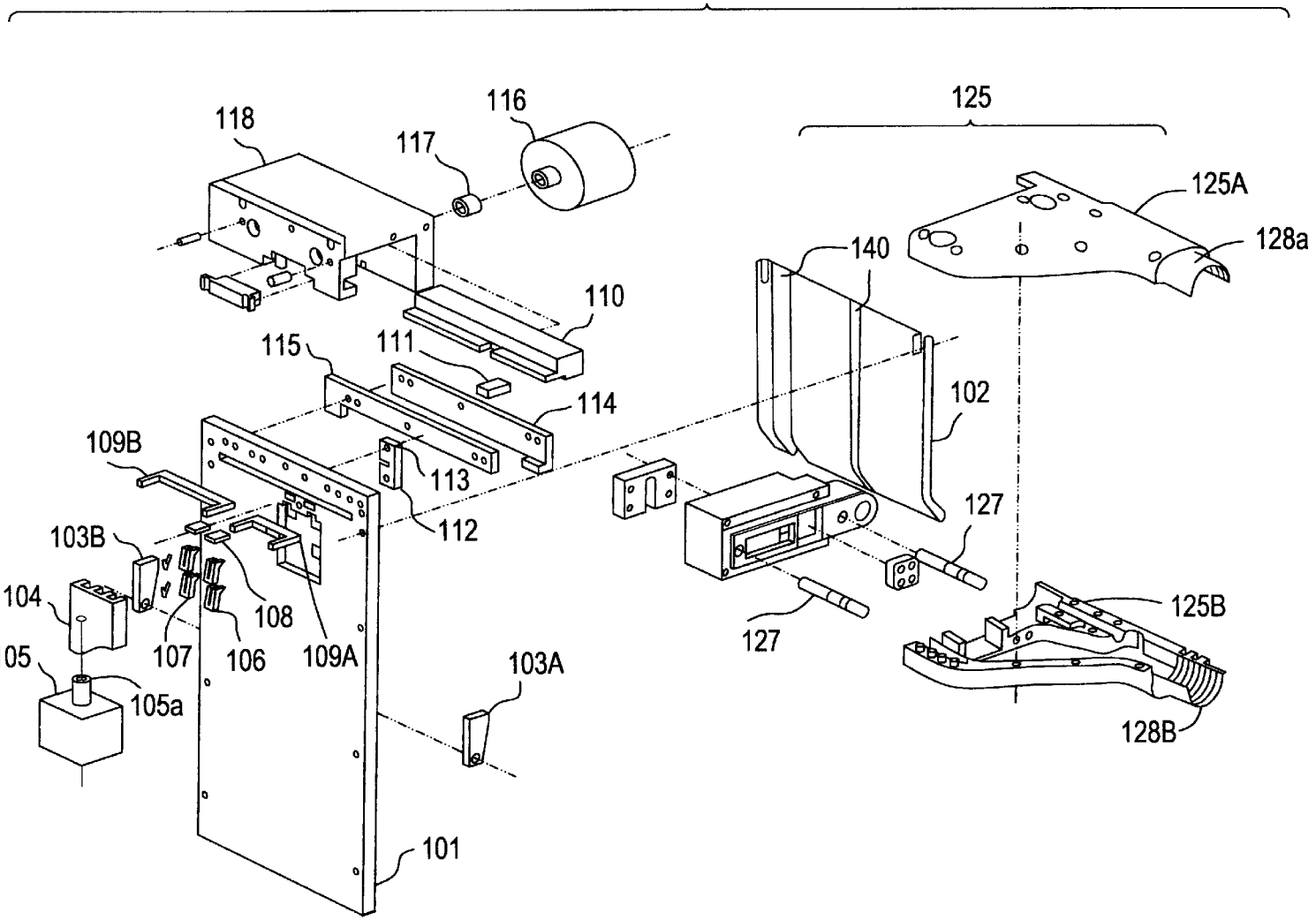
FIG. 8 is an exploded perspective showing of the components of the feeding and cutting apparatus of the present invention including a housing for a dispenser and a hose connector assembly affixed thereto.

Now referring to FIG. 8, the dispenser includes a base plate 101 attached to the top of the dispenser housing 2. A plurality of lateral slots 140 in base plate 101 and top plate 102 guide a cable tie bandolier 10' into the cutting area. Slots 140 are sized and shaped to accommodate the a cable tie 12 or 12' as it advances toward the firing chamber. Maintenance of the cable tie within the slots' substantially planar orientation promotes alignment of the bandolier, further assuring proper placement and orientation of the cable ties within the cutting area.

The bandolier 10' is pulled from the spool and fed into a cutting area by a pneumatic powered feed apparatus comprising a feed finger housing 104, a pneumatic powered cylinder 105, a plurality of feed fingers 106 and a plurality of hair pin fingers 107. Pneumatic powered cylinder 105 is attached to the underside of base plate 101. Feed finger housing 104 is attached to a rod on base plate 101 and extends into a pocket in the underside of base plate 101. Four feed fingers 106 rotate about pins inserted into the feed finger housing 104. Four hair pin fingers 107 apply force between the underside of the feed fingers 106 and the feed finger housing 104, resulting in a clockwise rotation of the feed fingers 106. Contact between the underside of the feed fingers 106 and the feed finger housing 104 limits the clockwise rotation of the feed fingers 106. The clockwise rotation of the feed fingers 106 caused by the force applied by the hair pin fingers 107 elevates the top forward faces of the feed fingers 106 through slots in the base plate and further into the spaces between the ties which are created by a web 14'. When the pneumatic cylinder 105 is extended, the feed finger assembly comprising housing 104, fingers 106 and hair pin fingers 107 are moved forward. The forward faces of the feed fingers 106 contact the aft faces of the ties 12' and advance the tie strip 10' forward toward the cutting area over a distance equal to the sum of the width of one tie and web.

Two spring-biased fingers 108 are projected through the base plate 101 by coil springs which apply force between the fingers and a press frame 118. The press frame 118 has a C-shaped cross-section that attaches to the underside of the base plate 101 and extends about the top surface of the base plate 101.

Fingers 108 enter the space between the ties created by the web 14'. The forward faces of the fingers 108 are perpendicular to the top face of the base plate 101. The top forward surface of the fingers 108 projects about the face of the base plate 101 a distance greater than the thickness of the tie. The top surface of the fingers 108 tapers from the forward face to the aft face to an elevation below the top face of the base plate 101, thereby creating a ramp which rises in the direction of the feed.

When the ties are advanced forward toward the cutting area by the feeding apparatus, the body of a leading tie contacts the ramp on the aft portion of the fingers 108. The bandolier is forced upward into the top plate 102 which is attached to the base plate 101 by the hinge brackets 103A and 103B and two shoulder screws. The resistance of this contact with the top plate 102 causes the coil springs supporting the fingers 108 to compress, allowing the fingers 108 to retract into the base plate 101. This allows the bandolier to feed forward. When the aft face of the body of the tie has fed past the forward face of the fingers 108, the coil springs will raise the fingers into the space between the ties created by the web. The forward perpendicular face of the fingers 108 now prevents the bandolier from moving in the aft direction. In the operating position, two ties and one web lie forward of the forward face of the fingers 108.

The base plate 101 has a through slot forward of the fingers 108 which is the width of the web and the length slightly longer than the length of the tie. This slot lies directly below the web when the belt of ties is in the cutting position. Two spring pads 109A and 109B fill the area of this slot in the base plate 101 that does not lie directly below the web or the areas along the length of the tie from the web to the tip of the tie and from the web beyond the head of the tie. The purpose of these spring pads 109A and 109B is to prevent the body, head or tip of the tie from snagging in the slot in the base plate 101 while the belt of ties is being fed forward into the cutting area. In the elevated position, the top surface of the spring pads 109A and 109B is flush with the top feed surface of the base plate 101. The spring pads 109A and 109B are elevated to this flush position by coil springs that apply force between the underside of the spring and the press frame 118.

Forward and aft of the slot in the base plate 101, replaceable cut-off dies 112 and 113 are inset into the top feed surface of the base plate so that their top surfaces are flush with the top surface thereof. Forward of the slot in the base plate 101 is attached a chamber stop 115. The thickness of the chamber stop 115 is slightly greater than the thickness of the head of the tie and its length is equal to the width of the base plate 101 . The aft face of chamber stop 115 is forward of the forward face of the slot in the base plate 101 by a distance slightly greater than the width of the head of the tie. The forward face thereof is flush with the forwardmost face of the base plate 101. The lower face of the chamber stop 115 rests against the top face of the base plate 101. The rear portion of the chamber stop 115 has a greater thickness and extends in the aft direction to the forward face of the slot in the base plate 101. This area is beyond the head of the tie in the lengthwise direction.

The chamber cap 114 is a plate that rests on top of the chamber stop 115 and extends from the forward face of the slot in the base plate 101 to the forwardmost face of the base plate 101. A plurality of screws and dowel pins passing through both chamber cap 114 and chamber stop 115 and attaching to the base plate 101 create a rectangular chamber with four closed sides the thickness, length and width of which are slightly greater than the corresponding dimensions of the tie. The aft side of the chamber is open to permit the tie to enter, and the front end of the chamber is open to allow the tie to exit after it has been cut free from the bandolier.

A pneumatic powered cut-off cylinder 116 attaches to the top of the press frame 118 with the cylinder rod positioned on the center of a web 14'. The rod of the cut-off cylinder 116 extends through the press frame 118 towards the base plate 101.

The pilot 110 attaches to the cut-off cylinder 116 and is separated by a spacer 117. The width and length of the pilot 110 is slightly less than the width and length of the slot in the base plate 101. The lower surface of the pilot 110 is tapered equally from center on the forward and aft faces to permit easy entry into the space between the ties created by the web.

A cut-off blade 111 is attached to the pilot 110, the forward and aft faces of which protrude slightly from the forward and aft faces of the pilot 110. The front, rear and top faces of the cut-off blade are contained within a pocket in the pilot and the lower face of the cut-off blade is positioned above the lowest full width portion of the pilot by a distance slightly greater than the thickness of the tie.

When the cut-off cylinder 116 extends, the pilot 110 enters the space between the ties created by the web and enters the slot in the base plate 101. This precisely positions the ties and web for cutting. The lower tip of the pilot 110 depresses the spring pads 109A and 109B. The cut-off blade 111 contacts the top of the web, and shearing against the cut-off dies 112 and 113 removes the web and expels it through an opening in the press frame. This frees the tie located in the chamber from the bandolier. The forward face of the pilot 110 seals against the aft face of the chamber cap 114 and the forward face of the slot in the base plate 101. This leaves the only open side of the chamber, a rectangular opening slightly larger than the width and thickness of the head of the tie, at the front face. Compressed air enters the chamber through an orifice in the rear face of the chamber stop 115 behind the head of the tie. This propels the tie from the chamber with sufficient velocity to deliver it through a long tube to the installation gun (not shown).

A long flexible feed tube extends between the dispenser apparatus and a cable tie installation tool so as to effectively transport cable ties therebetween. As shown in FIG. 8, a flexible feed tube connector assembly 125 is affixed to the dispenser apparatus so as to extend from the interior to the exterior thereof. Flexible feed tube assembly 125 includes a top connector piece 125*a* having a projection 128*a* and a bottom connector piece 125*b* having a correspondingly sized and shaped projection 128*b*. Projections 125*a* and 128*a* are configured so as to engage one another and retain a similarly sized and shaped flexible feeding tube therebetween. The connector pieces are brought together so as to form a port through which a flexible feed tube is inserted to establish a continuous path between the dispenser and the installation tool. Flexible feed tube assembly 125 is affixed to dispenser housing 2 by pins 127, or by any other attachment mechanism which is conducive to the operation of the dispenser apparatus.

Figure 9:
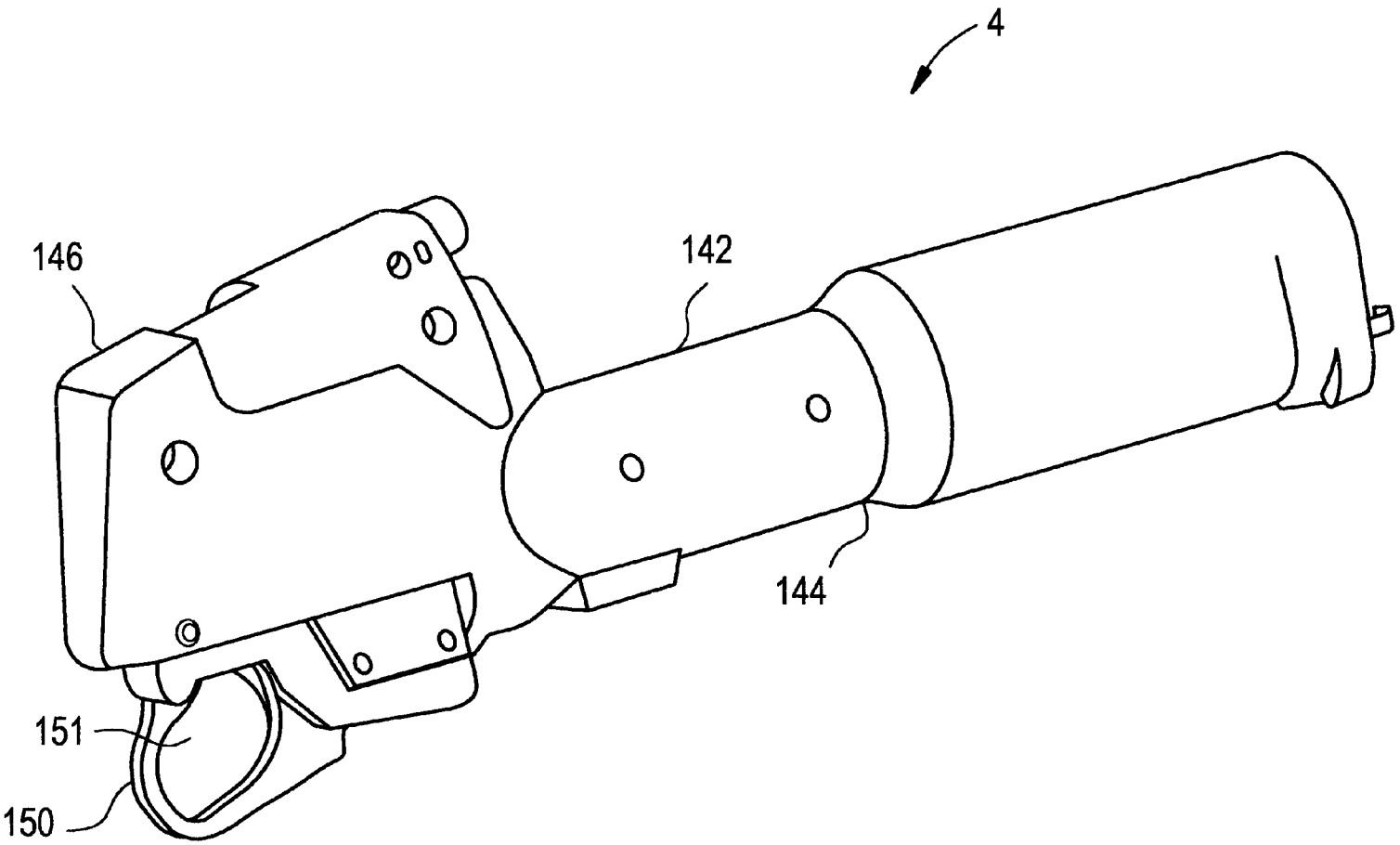
FIG. 9 shows a cable tool installation tool which can be used with the cable tie dispensing apparatus of the present invention.

An example of a cable tie installation tool 4 which can be used with the cable tie dispensing apparatus of the present invention is shown in FIG. 9. An automatic cable tie installation tool 4 includes a body 142 which supports the mechanisms contained within the tool. The rear end 144 of the tool body 142 is arranged for holding a connector for attaching a flexible feed tube which, by means of propelled and compressed air, directs a cable tie into the tool. The front end 146 of the tool includes a push button for enabling a particular mode of operation and a housing that accommodates a movable jaw defining a space 151 wherein a bundle of cables or similar articles may be inserted so that a tie may be applied therearound.

Operation of the tool is initiated by the user, preferably by retraction of a trigger on the body of the tool. When the trigger is depressed, the cable tie is immediately fired and arrives in the jaw. At the jaws, the head of the tie is guided around the wire bundle and the head hits a solid stop. Before hitting the stop, the head is decelerated, ensuring that the head is properly oriented to accept the threading of the tie head.

The dispensing and installation cycle can be carried out by a programmable logic controller. The trigger starts the cycle and each step within the cycle is executed by means of timing the various mechanical devices. Sensors may be included in either the dispenser or the installation tool which detect when the tie head hits the stop and automatically cease the operation cycle. The programmable controller can be housed within the dispenser housing.

Thus, the present invention provides a simple and effective technique for propelling cable ties from a dispenser to an installation tool which operates with less complicated components thereby reducing failure modes.

Various changes to the foregoing described and shown structures would now be evident to those skilled in the art. Accordingly, the particularly disclosed scope of the invention is set forth in the following claims.

What is claimed is:

1. A dispensing apparatus for severing a cable tie from a bandolier of interconnected cable ties and thereafter transferring said severed cable tie to a cable tie installation tool, said apparatus comprising:

a firing chamber having an entrance for advancement of a leading cable tie therein;

a movable door for sealing said leading cable tie within said chamber;

a cutter for severing said leading cable tie from said bandolier following advancement of said leading cable tie into said firing chamber; and a feed mechanism for advancing said interconnected cable ties until said leading cable tie is advanced into said firing chamber.

2. The apparatus according to claim 1, wherein said firing chamber defines a volume sized and shaped to enclose said severed cable tie prior to transfer of said severed cable tie to said installation tool.

3. The apparatus according to claim 2, wherein said firing chamber further includes an inlet for injection of pressurized air therein and an outlet for exit of said severed cable tie from said chamber upon injection of said pressurized air.

4. The apparatus according to claim 1, further comprising a support surface for advancement of said interconnected ties therealong, and wherein said feed mechanism is positioned proximate said support surface to allow cooperation with said interconnected ties positioned thereon.

5. The apparatus according to claim 4, wherein said support surface is planar, and further comprising a planar boundary surface located proximate said support surface and fixed parallel thereto whereby a cable tie passage is defined therebetween.

6. The apparatus according to claim 1, wherein said cutter is located on said movable door, whereby movement of said door to seal said firing chamber simultaneously severs said leading tie from said bandolier.

7. The apparatus according to claim 6, wherein said movable door includes opposed walls, said walls being progressively engageable with said leading cable tie and a cable tie adjacent thereto upon movement of said door whereby separation of said leading cable tie from said adjacent cable tie is effected.

8. The apparatus according to claim 1, further comprising a housing for supporting said firing chamber, movable door, cutter and feed mechanism;

wherein said bandolier of interconnected cable ties are stowed on a spool; and further comprising an arm attached to said housing, said arm having a mandrel at one end for rotatable support of said bandolier thereon.

9. The apparatus according to claim 8, wherein said arm is pivotable between a first operating position and a second storage position.

10. The apparatus according to claim 8, further comprising a quick release lock assembly for releasably securing said spool on said mandrel.

11. The apparatus according to claim 1, wherein said feed mechanism includes at least one finger located to engage said bandolier and rotatable between a first position whereat said finger engages said bandolier for advancement thereof towards said firing chamber and a second position whereat said finger may be translated away from said firing chamber without associated movement of said bandolier; and wherein said feed mechanism further includes a linear actuator for moving said finger.

12. The apparatus according to claim 11, wherein said finger is sized to fit between adjacent ties of said bandolier and wherein said finger has a forward face for contacting said bandolier upon movement of said finger.

13. The apparatus according to claim 11, further comprising a support surface for advancement of said interconnected ties therealong; and at least one movably mounted anti-backup pawl located to extend between adjacent ties, said pawl being movable between a first position whereat said pawl extends between adjacent ties and a second position whereat said pawl allows advancement of said interconnected ties along said surface, said pawl including an angled surface for receipt of an advancing cable tie thereon whereupon said pawl is caused to move from said first position to said second position to allow said advancing cable tie to travel toward said firing chamber, said pawl being biased to said first position and including a face perpendicular to said surface for contacting a rearward portion of said advancing cable tie after said advancing cable tie has traversed said pawl whereupon rearward movement of said bandolier is prevented.

14. A dispensing apparatus for advancing and severing a cable tie from an elongate strip of adjacent side-by-side cable ties interconnected by a web and for delivering severed cable ties to a cable tie installation tool, said apparatus comprising:

a support surface for supporting said cable tie strip;

advancement means for advancing said cable tie strip along said surface;

a severing location adjacent one end of said surface for supporting one cable tie of said strip;

an alignment pilot supported adjacent said severing location, said alignment pilot being movable towards said severing location for insertion between said one cable tie and an adjacent said cable tie so as to separate and space said one cable tie from said adjacent cable tie;

said alignment pilot including a punch for severing said web between said one cable tie and said adjacent cable tie upon said movement of said pilot towards said severing location so as to separate said one cable tie from said web and for positioning said one separated cable tie for delivery to said cable tie installation tool.

15. The dispensing apparatus according to claim 14, wherein said advancement means includes:

a retractable cable tie finger movable through said surface for contacting an intermediate cable tie of said strip and advancing said strip along said surface in a first direction towards said severing location.

16. The dispensing apparatus according to claim 15, wherein said cable tie finger is engageable with said intermediate cable tie to prevent movement of said strip in a second direction opposite said first direction upon movement of said pilot towards said severing location.

17. The dispensing apparatus according to claim 14, wherein said severing location includes:

a firing chamber having an entrance for permitting insertion of said one cable tie thereinto, said entrance being sealably closed by said movement of said pilot toward said severing location; and means operable with said firing chamber for delivering said separated cable tie to said installation tool.

18. The dispensing apparatus according to claim 17, wherein said delivering means includes an air cylinder for injecting air into said firing chamber to propel said separated cable tie towards said installation tool.

19. The dispensing apparatus according to claim 17, wherein said pilot is an elongate member having a pair of opposed walls, said walls being progressively engageable with said one cable tie and said adjacent cable tie upon said movement of said pilot to effect said separation of said one cable tie and said adjacent cable tie.

20. The dispensing according to claim 19, wherein said progressive engagement of said pilot with said one cable tie urges said one cable tie into aligned position within said firing chamber.

21. The dispensing apparatus according to claim 20, wherein said opposed walls of said pilot are inwardly tapered in transverse cross-section toward said severing location.

22. The dispensing apparatus according to claim 21, wherein opposed longitudinal ends of said elongate pilot are inwardly beveled towards said severing location.

23. The dispensing apparatus according to claim 22, wherein said cable ties are elongate having a head at one end and a tail at the other end and wherein said side-by-side cable ties are interconnected at a location between said head and said tail.

24. The dispensing apparatus according to claim 23, wherein said pilot includes said punch at a location intermediate said beveled longitudinal ends.

25. A method for advancing and severing a cable tie from a strip of side-by-side cable ties interconnected by a web and for delivering said severed cable tie to a cable tie installation tool comprising the steps of:

positioning one cable tie of said strip within a firing chamber, said firing chamber specifically separating said one cable tie from an adjacent said cable tie;

severing said web from said strip between said one cable tie and said adjacent cable tie;

enclosing said one cable tie in said firing chamber; and delivering said one cable tie from said firing chamber to said installation tool.

26. The method according to claim 25 wherein said separating, severing and enclosing steps further include:

providing an elongate alignment pilot having opposed longitudinal walls and a pilot punch;

moving said pilot towards said strip so that said opposed longitudinal walls separate said one cable tie and said adjacent cable tie, said pilot punch severs said web and said pilot encloses said one cable tie in said firing chamber.

27. A method according to claim 26 wherein said delivery step includes:

pneumatically propelling said cable tie from said firing chamber to said installation tool.

28. The method according to claim 26, wherein said positioning step includes:

linearly advancing said strip towards said firing chamber.

29. The method according to claim 28 wherein said advancing step includes:

providing a support surface for supporting said strip;

providing a retractable finger movable adjacent said surface for contacting an intermediate cable tie of said strip;

moving said finger into engagement with an intermediate cable tie of said strip and translating said finger towards said firing chamber to move said strip towards said firing chamber.

* * * * *